US006987429B2

(12) United States Patent
Shih et al.

(10) Patent No.: US 6,987,429 B2
(45) Date of Patent: Jan. 17, 2006

(54) UNIVERSAL MILLIMETER-WAVE HOUSING WITH FLEXIBLE END LAUNCHERS

(76) Inventors: Yi-Chi Shih, 2220 Thorley Pl., Palos Verdes Estates, CA (US) 90274; Long Q. Bui, 2630 Via Rivera, Palos Verdes Estates, CA (US) 90274; Tsuneo Shishido, 30217 Chartier Dr., Rancho Verdes Estates, CA (US) 90275

( * ) Notice: Subject to any disclaimer, the term of this patent is extended or adjusted under 35 U.S.C. 154(b) by 57 days.

(21) Appl. No.: 10/038,459

(22) Filed: Jan. 7, 2002

(65) Prior Publication Data

US 2002/0186105 A1 Dec. 12, 2002

Related U.S. Application Data

(62) Division of application No. 09/433,318, filed on Nov. 3, 1999, now Pat. No. 6,363,605.

(51) Int. Cl.
*H01P 5/103* (2006.01)

(52) U.S. Cl. ..... 333/26; 333/33

(58) Field of Classification Search ..... 333/26, 333/33

See application file for complete search history.

(56) References Cited

U.S. PATENT DOCUMENTS 5,198,786 A * 3/1993 Russell et al. ..... 333/26
5,359,339 A * 10/1994 Agrawal et al. ..... 333/26 X
6,363,605 B1 * 4/2002 Shih et al. ..... 333/26 X

* cited by examiner

*Primary Examiner*—Benny Lee

(57) ABSTRACT

A precision non-symmetrical L-shape waveguide end-launching probe for launching microwave signals in both vertical and horizontal polarizations is disclosed. The L-shape waveguide probe is in a form of thin plate, has a first arm and a second arm, and is precisely fabricated and attached to one end of the central metal pin of a feedthrough. The feedthrough is installed to an aperture formed in a major wall of the universal conductive housing to achieve hermetic sealing. The L-shape waveguide probe is aligned by means of a specially designed alignment tool so that long axis of the second arm is always perpendicular to the broad walls of the output waveguide, which is mounted to the universal housing with the broad walls of the output waveguide either horizontally or vertically. Hence, in this invention, an end-launching arrangement using the L-shape probes that could yield a flexible waveguide interface either in horizontal polarization or vertical polarization is provided. The impedance matching and frequency bandwidth may be adjusted by controlling dimensions and positions of the L-shape probe. A plurality of the thin plate L-shape waveguide probes is fabricated by a micro lithography and etching method to ensure reproducibility and reliability. By incorporating with an impedance transformation section having a slot, broad band performance is achieved using the L-shape waveguide probe.

9 Claims, 4 Drawing Sheets

UNIVERSAL MILLIMETER-WAVE HOUSING WITH FLEXIBLE END LAUNCHERS

This is a divisional patent of the application Ser. No. 09/351,362, filed by Yi-Chi Shih, Long Q. Bui and Tsuneo C. Shishido on Jul. 12, 1999, now U.S. Pat. No. 6,363,605 issued on Apr. 2, 2002.

FIELD OF THE INVENTION

This invention relates generally to a precision non-symmetrical waveguide probe and a universal impedance transformation section for launching microwave signals for broad band applications. More particularly, the invention relates to an end-launcher with a non-symmetrical waveguide probe for operation in both vertical and horizontal polarization and with improved frequency bandwidth.

BACKGROUND OF THE INVENTION

The recent development of data communications and personal communication systems (PCS) has led to a drastic increase in the traffic in RF transmission. In order to meet this increase, communication systems at millimeter wave frequencies (greater than 25 GHz) are required. The circuits for operation at these high frequencies are generally fabricated using semiconductors with high electron mobility, such as GaAs and related compounds, and are often called Monolithic Microwave Integrated Circuits (MMICs). These MMICs must be mounted in a housing with other components to form a complete module. The requirements for an ideal housing include: [1] universal RF input/output terminals for coaxial and/or waveguide interfaces, [2] hermetically sealed terminals for DC and RF, [3] gold plating for thermal compression bonding, [4] proper cavity design to minimize moding and [5] mounting interface for heat sink attachment.

Since the wavelength of a millimeter wave is short, the requirements for the MMICs fabrication and the tolerance of alignment and dimensions of parts are critical. Hence, a slight deviation of the dimensions or position of parts used in the housing and specifically in connection from the predetermined values may result in poor performance of the entire module. This is particularly true for the RF input and output transitions. In addition to the design and fabrication of MMICs, one of the critical steps for obtaining a high quality millimeter wave module is to provide a precise and reproducible RF transition between the MMICs and connection means attached to the housing.

The requirements for the RF transition include the following: [1] a glass bead directly mated with coaxial connectors, [2] a precisely fabricated probe attached to the bead for proper impedance matching. A transition between a waveguide and microstrip line has been reported in "1988 IEEE MTT-S Digest, pp. 473–474" entitled "Waveguide-to-Microstrip Transitions for Millimeter-Wave Applications" by Yi-Chi SHIH Thuy-Nhung TON and Long Q. BUI, both SHIH and BUI are also the common co-inventors of the present invention. For the method involving waveguide-to-microstrip transition, dimensions of the microstrip line must be controlled precisely and aligned to an aperture in the wall of the housing in order to achieve matched impedance, for example 50 ohms. For reliable operation, the microstrip line part must be secured to the aperture of the housing, which often affects the alignment of the microstrip to the aperture of the housing.

A millimeter wave waveguide launch transition feedthrough was also disclosed in U.S. Pat. No. 5,376,901 entitled "Hermetically Sealed Millimeter Waveguide Launch Transition Feedthrough" granted to Steven S. Chan, Victor J. Watson, Cheng C. Yang and Stuart Kam. An electrically conducting pin with a cylindrical or conical conductive bead head is first formed into a waveguide probe for the transition feedthrough. The transition feedthrough is then mounted in an aperture of a housing with the bead head extending inside an integrated waveguide. Using their method and structure, it is difficult to obtain positional reproducibility of the bead head with respect to the integrated waveguide, especially for applications at millimeter wave frequencies. This is because there is always a gap between the ring and inner wall of the aperture in the housing. Hence, the uniformity of the transition feedthrough in the final modules can not be guaranteed. In addition, the fabrication of the cylindrical or conical waveguide probes is relatively expensive due to the tight requirements in dimensions and position of the central hole.

In order to achieve low cost production of millimeter wave modules, it is preferable to use housings with the same structure and dimensions for different modules. To achieve this, the housings should allow RF input and output to be achieved with either coaxial connector or waveguide connector. The housings should preferably be capable of hermetic sealing in order to isolate the MMICs and components from environmental contaminants.

In U.S. patent application Ser. No. 09/35 1,362, filed by Yi-Chi Shih, Long Q. Bui and Tsuneo C. Shishido on Jul. 12, 1999, now U.S. Pat. No. 6,363,605, a universal conductive housing for different millimeter wave MMICs with a feedthrough has been disclosed. A plate shape waveguide probe, which is symmetrical and fabricated by a micro lithography and etching method, is aligned using a precision alignment tool with respect to a pin of the feedthrough and welded or soldered by a miniature solder. The uniformity and reliability of the waveguide transition has been improved using the structure described in the U.S. Pat. No. 6,363,605. However, since the waveguide probes described in that invention are symmetrical and aligned perpendicular to the major exterior wall of the universal conductive housing and perpendicular to the broad walls of the waveguide, the electric field polarization is always perpendicular to the major exterior wall of the universal conductive housing. Hence, the input/output waveguide interface always forms a 90 degrees angle with respect to the normal of major walls of the universal conductive housing. In many applications, it is very desirable and sometimes necessary to integrate components in-line with the main housing at the waveguide input/output interfaces, i.e. the long axis of the input/output waveguide interface should form a near zero degree angle with respect to the normal of major walls of the universal housing. This requirement thus creates a need to have a new arrangement and structure for the waveguide probe. Furthermore, it is preferable to have a waveguide transition with operating frequency range broader than the previous structure involving symmetrical waveguide probes.

SUMMARY OF THE INVENTION

This invention provides a non-symmetrical waveguide probe incorporated with a universal adapter to form a microwave end-launcher. The non-symmetrical waveguide probe is made of a thin plate, preferably in an L-shape and with an aligning slot along the central axis of the first arm. A second arm is arranged to be substantially perpendicular to the first arm in order to obtain controlled electric field polarization. The L-shape waveguide probe may be positioned precisely by an alignment jig so that the slot is aligned to the pin of a feedthrough before welding or soldering. By aligning the L-shape waveguide probe so that the long axis of the second arm is perpendicular to the broad walls of the output waveguide, an end launcher with vertical electric field polarization, with respect to the main housing reference plane, is obtained after the welding or soldering.

The electric field polarization may be changed from perpendicular to parallel to the main housing reference plane by rotating the L-shape waveguide probe and universal launcher adapter. By controlling the dimensions of the L-shape waveguide probe and the positions in the output waveguide, the central frequency of operation may be adjusted and the frequency range of operation of the transition may be increased. Since the L-shape waveguide probes are preferably manufactured by a micro lithography and etching method, not only the dimensions of each probe can be kept to the designed values but also the cost may be reduced. Furthermore, with the precision alignment method provided in this invention, the uniformity of characteristics of the waveguide probes produced among different modules may be achieved.

BRIEF DESCRIPTION OF THE DRAWINGS

FIG. 1(*b*) is a schematic top view of a conductive housing for MMICs. FIG. 1(*c*) is a prior art symmetrical waveguide probe.

FIG. 3(*c*) is a waveguide section for receiving and propagation of microwave signals excited by the L-shape waveguide probe. FIG. 3(*d*) is a universal launcher adapter rotated by 90 degrees for the excitation of microwave signals with horizontal electric field polarization FIG. 3(*e*) is a schematic front view of the universal launcher adapter showing a slot formed in the through channel for impedance transformation.

FIG. 4(*b*) is a top view of the first photomask used. FIG. 4(*c*) is a cross sectional view of the substrate after etching of the exposed regions. FIG. 4(*d*) is a top view of etched waveguide probes connected by fine brass wires.

DETAILED DESCRIPTION OF THE PREFERRED EMBODIMENTS

Figure 1A:
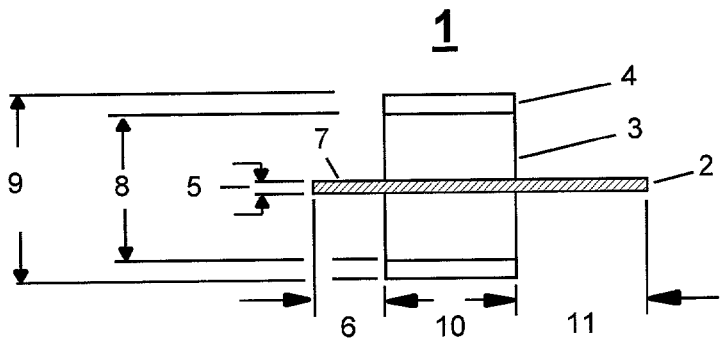
PRIOR ART Fig. 1(a)
FIG. 1(*a*) is a schematic cross-sectional view of the prior art feedthrough for use with the housing shown in FIG. 1(*b*).
Figure 1B:
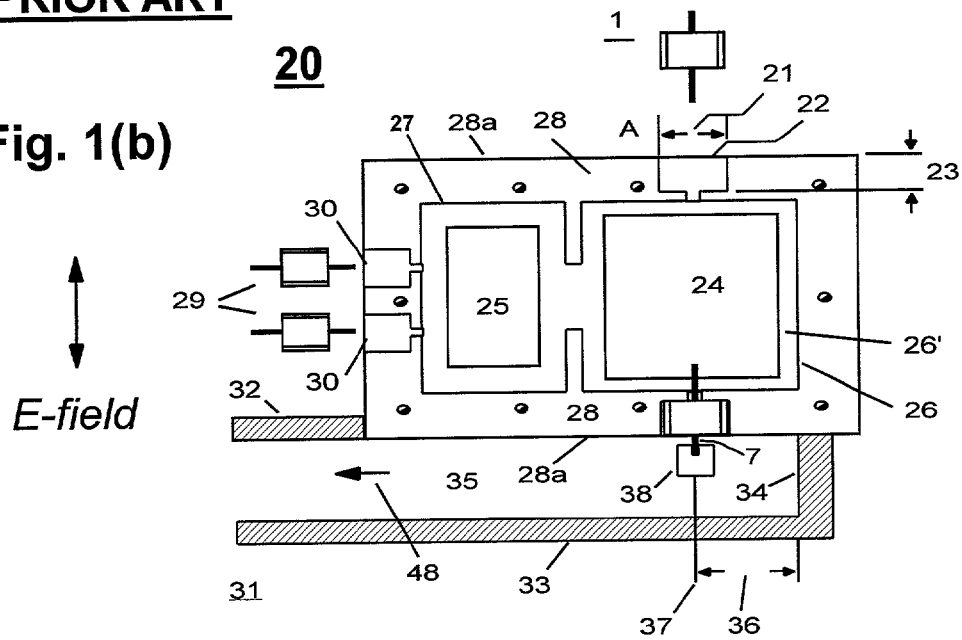
PRIOR ART Fig. 1(b)
Figure 1C:
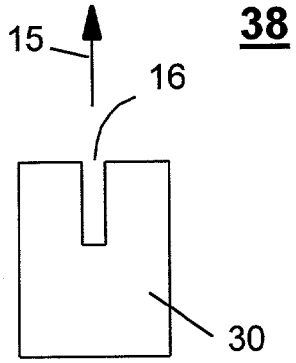
PRIOR ART Fig. 1(c)

Referring to FIG. 1(*a*), there is shown according to the prior art method an RF feedthrough (1) consists of a central metal pin (2), hereinafter called pin, which is partly enclosed with glass (3) and a metal ring (4). Diameter (5) and length (6) of first part (7) of the pin and inner diameter (8) of the metal ring may be designed according to known prior art method so that when installed to a conductive housing, the impedance of the RF feedthrough can be matched with the characteristics impedance of the MMIC. For instance, a pin with a diameter of 10 mil may be used. The outer diameter (9) of the metal ring is about 10 –20 micrometers smaller than the main diameter (21) of the bores (22) shown in FIG. 1(*b*) of a universal conductive housing. Furthermore, the length (10) of the metal ring (4), or the second length of pin, is selected to be substantially equal to the major depth (23) of the bores as shown in FIG. 1(*b*). The third length (11) of the pin is selected so that contact attachment or wire bonding can be easily performed to the MMIC (24) of FIG. 1(*b*)

FIG. 1(*b*) shows a universal conductive housing (20) according to a prior art, hereinafter called housing for an MMIC (24) and components (25) for control and biasing. The housing is constructed preferably with conducting materials such as brass or A1. At least one cavity (26) with a platform (26') is created to accommodate the MMIC (24). A second cavity (27) may also be created to accommodate other components (25). Bores (22) with a major depth (23) are cut through two parallel major walls (28) of the housing, to accommodate transition RF feedthrough beads (1). The major depth (23) of the bores is selected so that the RF feedthrough beads (1) may be used to direct microwave signals from/to the MMIC. Each of the parallel major walls (28) has one major exterior wall (28*a*). At least one DC feedthrough (29) may be installed to bores (30) for supplying dc power or a control signal to the MMIC.

To form a waveguide transition according to U.S. Pat. No. 6,363,605, a plate shape waveguide probe (38), which is symmetrical with respect to the long axis (37) of pin, is attached to the end of the first part of the pin (7). As shown in FIG. 1(*c*), the waveguide probe (38) according to the previous invention is symmetrical with respect to the axis (15) of the slot (16). The symmetrical waveguide probe is characterized by a major probe wall (30). Although the plate shape waveguide probe (38) may be fabricated by mechanical machining methods, a micro lithography and etching method may be preferably used.

The waveguide probe (38) is aligned and soldered or welded to the end of the first part (7) of the pin extending outside the housing, as shown in FIG. 1(*b*). After this, a section of waveguide (31), having two broad side walls (32,33) and an end wall (34), is aligned and mounted to the exterior major wall (28) of the housing (20). It is noted that a portion of the broad side wall (32) of the waveguide has been removed whereas the other broad side wall (33) is intact, so that when the section of waveguide is mounted and attached to the housing, a complete waveguide cavity (35) is formed. The end wall (34) of the section of waveguide is adjusted so that the distance (36) between the end wall (34) and the central line (37) of the waveguide probe is substantially equal to a quarter of the wavelength of the microwave signals (39) to be propagated. FIG. 1(*c*) shows a prior art waveguide probe (38) with a main probe body (30) and a slot (16). The slot has an axis (15) for connection to the first part (7) of central metal pin (2) (FIG. 1(*b*). According to the prior art structure, the electric field or E-field (39') of the microwave signals (39) will be perpendicular to the broad side walls (32,33) (FIG. 1(*b*)) or parallel to broad walls (20*b*) defining a reference plane as depicted in FIG. 3(*a*).

In most of the prior art methods, cylindrical or conical beads are used as the waveguide probes in waveguide transition. These beads are symmetrical and have certain performance limits. In addition to the higher cost for the fabrication, it is rather difficult to attach the cylindrically- or conically-shaped beads to ends of fine metal pins, especially for high frequency coaxial/waveguide transitions. Since the launching efficiency and frequency response of a waveguide/coaxial transition are determined by the shape, dimensions and position of the waveguide probe within the waveguide, it is more difficult to achieve microwave transitions using the prior art cylindrical or conical beads. Even the plate shape waveguide probe disclosed in U.S. Pat. No. 6,363,605 is symmetrical with respect to the central axis. Hence, when the prior art waveguide probe is mounted to the pin of a feedthrough, the waveguide probe is always symmetrical with respect to central line (37).

During the system integration, it is often necessary to combine several components or modules at their waveguide interfaces. For some components, it may be preferable to have the electric field of microwave signals, which is always perpendicular to the broad walls of the waveguide, to be parallel to or perpendicular to a reference plane. In the present description, the reference plane is taken as the broad walls (20*b* in FIG. 3(*a*)) of the universal conductive housing. Hence, in FIG. 1(*b*), the corresponding reference plane is the plane parallel to the top view plane. The reference plane is shown as the plane defined by a broad wall (20*b*) given in FIG. 3(*a*). It is noted that it is preferable to fabricate the conductive housing so that the reference plane defined by the broad wall is substantially parallel to a plane defined by the MMIC (24). Furthermore, it is preferable to have the major exterior wall (28*a*) to be perpendicular to the reference plane. When the electric field of the microwave signals is parallel to the reference plane (20*b*) and major walls (28*a* in FIG. 3(*a*)) of the universal housing, it is normally referred to as the horizontal polarization. For other components, it may be preferable to have the electric field perpendicular to the reference plane, which is referred to as the vertical polarization. As a result, waveguide twists are often required in the integration using prior art waveguide probes, which require more volume, weight and cost. Since the universal launcher adapters in this invention are to serve as the interface between the universal conductive housing and the waveguides, it is very desirable to be able to interface microwave signals from the MMIC with other components in either vertical or horizontal polarization.

Figure 2:
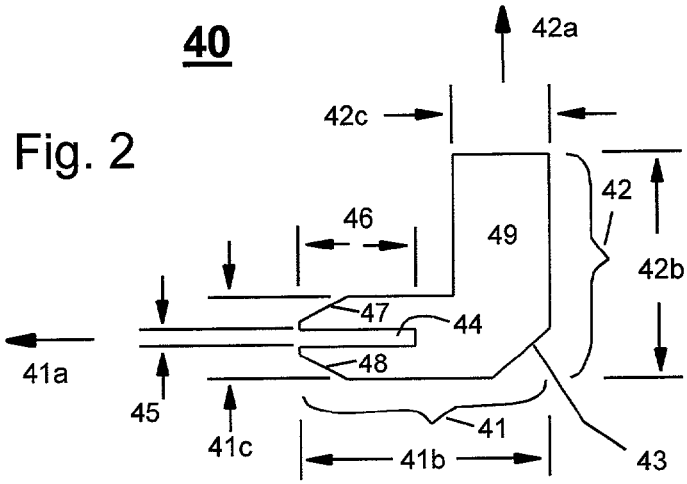
FIG. 2 is a schematic top view of the L-shape non-symmetrical waveguide probe with the first arm and the second arm according to this invention.
Figure 3A:
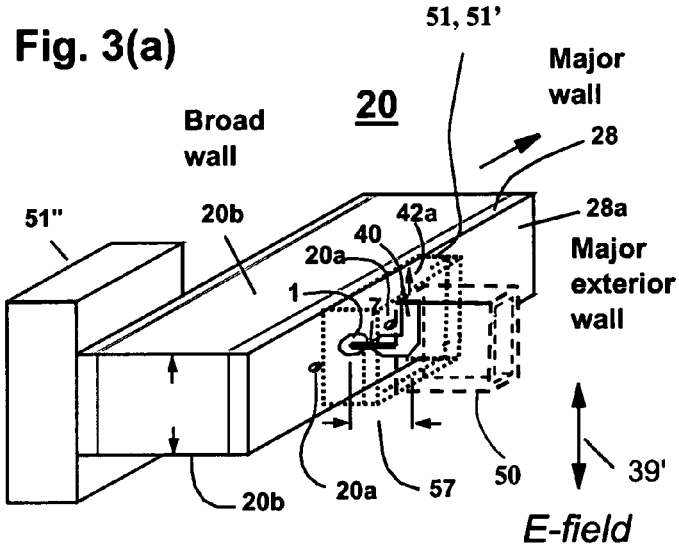
FIG. 3(*a*) is a schematic view of the conductive housing with an L-shape waveguide probe FIG. 3(*b*) is a schematic view of a universal launcher adapter excitation of microwave signals with vertical electric field polarization.
Figure 3E:
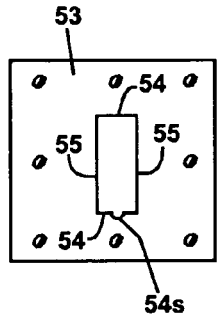
Figure 3B:
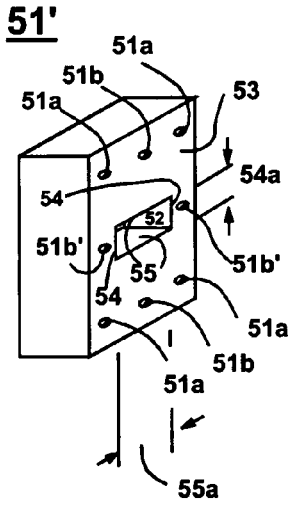
Figure 3D:
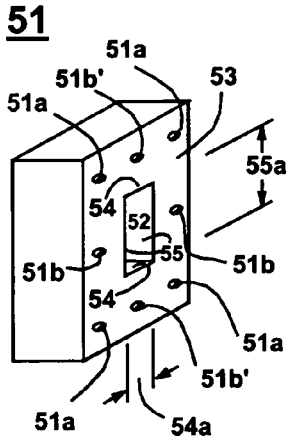
Figure 3C:
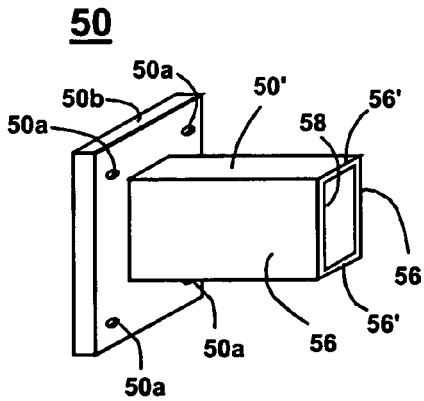
Figure 4A:
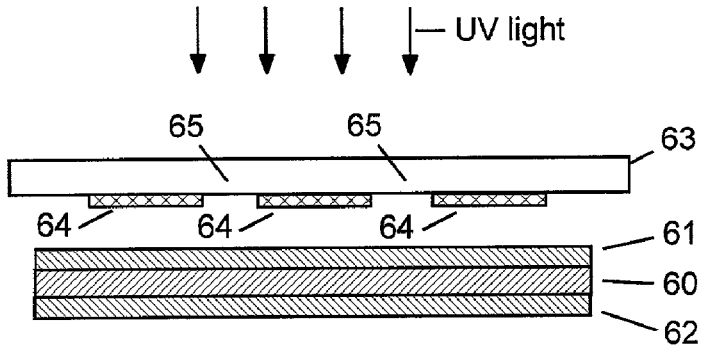
FIG. 4(*a*) is a schematic cross-sectional view of the metal substrate with two photoresist layers coated on the two surfaces for the fabrication of non-symmetrical L-shape waveguide probes.
Figure 4B:
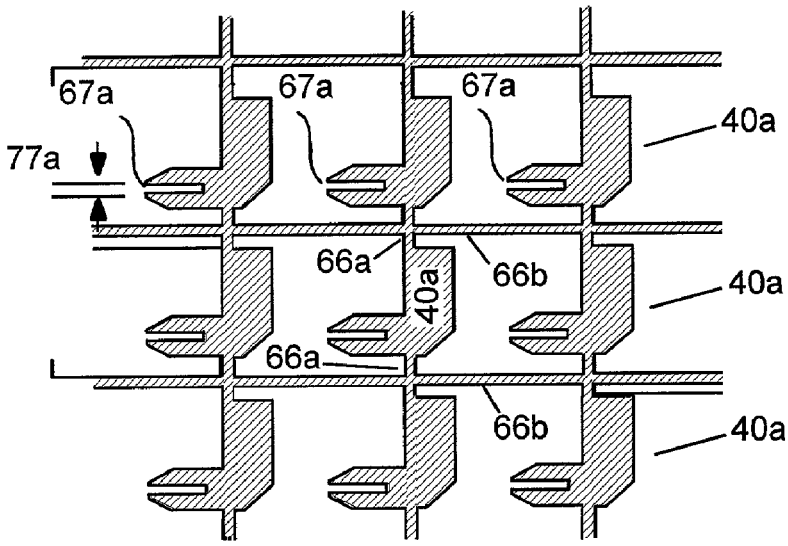
Figure 4C:
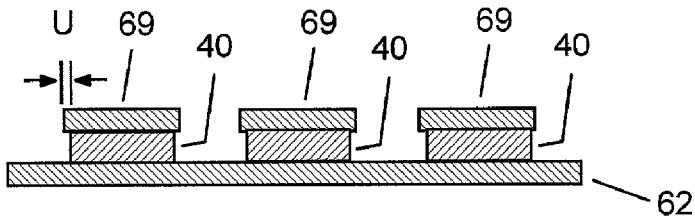
Figure 4D:
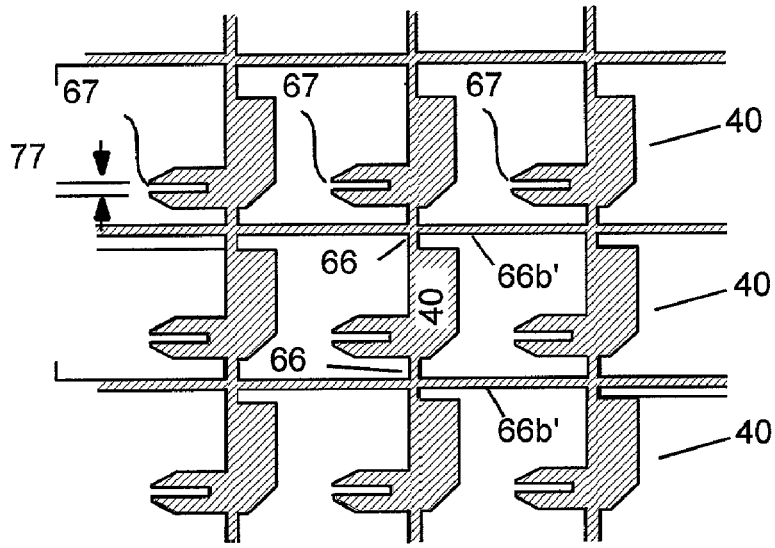

According to a first embodiment of this invention, a non-symmetrical waveguide probe (40) as shown in FIG. 2 is provided to improve the control of polarization and bandwidth. The non-symmetrical waveguide is very different from the prior art symmetrical waveguide probe both in geometrical shape and in the characteristics of electrical excitation. The non-symmetrical waveguide probe (40) is made of a thin plate of metals or alloys such as brass or copper. Thickness of the plate for the non-symmetrical waveguide probes is in the order of 10 mils. The waveguide probe consists of a first arm (41) and a second arm (42). The long axis (41*a*) of the first arm is arranged to be substantially perpendicular to the long axis (42*a*) of the second arm so that they form an L-shape non-symmetrical waveguide probe. A slot (44) is formed in the central left portion of the first arm. Width (45) of the slot is slightly greater than the diameter (5) of pin (7) shown in FIG. 1(*a*) whereas the length (46) of the slot is less than the length (6) of the first part on the pin (7). Corner (43) of the overlapped region between the first arm and the second arm is rounded whereas left-hand corners (47, 48) of the first arm are also rounded in order to improve the launching performance of the microwave signals. The L-shape waveguide probe is also characterized by a first broad wall (49) and a second broad wall (not shown) which are parallel to the long axis (41*a*) and the long axis (42*a*).

Length (41*b*) of the first arm is selected to be substantially equal to length (42*b*) of the second arm whereas width (41*c*) of the first arm is selected to be substantially equal to width (42*c*) of the second arm. In addition, the length (41*b*) is selected to be approximately equal to a quarter of wavelength of the microwave signals to be excited. It is noted that the relative dimensions provided above for the non-symmetrical waveguide probe are given only as an example. Relative dimensions different from the ones given may be used according to the wavelength range of operation. Furthermore, the angle between axis (41*a*) and axis (42*a*) may be slightly different from 90 degrees as long as the axis (42*a*) can be aligned to be parallel to major exterior wall (28*a*). Although the non-symmetrical waveguide probes may be manufactured by precision mechanical machining, it is preferable to manufacture them by micro lithography and etching processes. In subsequent part of the description, a procedure employing micro lithography will be specifically described.

To form a microwave end launcher with controlled polarization and improved frequency bandwidth, the non-symmetrical waveguide probe (40) is mounted at one end (7) of the pin of a feedthrough (1), as shown n FIG. 3(*a*). The feedthrough is mounted in a major wall (28) of a conductive housing (20). The conductive housing has two broad walls (20*b*), a major exterior wall (28*a*) and is formed by metals or alloys. There are threaded holes (20*a*) for the mounting of a waveguide section. The long axis (42*a*) of the second arm (40) of an L-shape non-symmetrical waveguide probe is aligned to be substantially parallel to the major exterior wall (28*a*). Inside the conductive housing there are MMICs and components. To facilitate the mounting of a waveguide section (50, in FIG. 3(*c*)) for receiving and guiding the microwave signals excited by the non-symmetrical waveguide probe, a universal launcher adapter (51', FIG. 3(*b*) or 51 in FIG. 3(*d*)) is provided. The universal launcher adapter (51) as shown in FIG. 3(*d*) is constructed by metals, alloys or plastic materials with layers of metals coated on all walls. A through channel (52) is arranged in the center region of the broad wall (53). The through channel is defined by two long walls (55), defining a height (55*a*), and two short walls (54), defining a width (54*a*). Both the width (54*a*) and height (55*a*) of the through channel are selected to be the same as that for the inner cavity (58) of the waveguide section (50) used, which has two broad waveguide walls (56) as shown in FIG. 3(*c*). To facilitate the mounting of the universal launcher adaptor (51) to the major exterior wall (28*a* FIG. 3(*a*)), two screw holes (51*b*) are provided. To allow the mounting of the waveguide section (50) to the universal launcher adaptor (51), threaded holes (51*a*) are provided. Here threaded holes (51*a*) are aligned to screw holes (50*a*) in a flange (50*b*) in the waveguide section (50 FIG. 3(*c*)). The waveguide section (50) has a waveguide (50') with two broad walls (56) and two narrow walls (56') defining a waveguide channel (58). Dimensions of cross-section of the waveguide channel (58) are substantially the same as those of the through channel (52) in the universal launcher adaptor. The universal launcher adapter (51') in FIG. 3(*b*) is similar to that of the adaptor (51) and is constructed by metals, alloys or plastic materials with layers of metals coated on all walls. A through channel (52) is arranged in the center region of the broad wall (53). The through channel is defined by two long walls (55), defining a height (55*a*), and two short walls (54), defining a width (54*a*). Both the width (54*a*) and height (55*a*) of the through channel are selected to be the same as that for the waveguide channel (58) of the waveguide section (50) used, which has two broad waveguide walls (56). To facilitate the mounting of the universal launcher adaptor (51') to the major exterior wall (28*a* FIG. 3(*a*)), two screw holes (51*b*) are provided. To allow the mounting of the waveguide section (50) to the universal launcher adaptor (51), threaded holes (51*a*) are provided. Here threaded holes (51*a*) are aligned to screw holes (50*a*) in the flange (50*b*) in the waveguide section (50 FIG. 3(*c*)). It is noted that the universal launcher adaptor (51) is similar to the universal launcher adaptor (51') except that the long walls (55) for adaptor (51) are perpendicular the long walls (55) of adaptor (51'). By providing a precision slot (54*s* in FIG. 3(*e*)) in one of the two short walls, the universal launcher adapter also serves as a universal impedance transformation section. Another universal lunched adapter (51") may also be connected to the same universal conductive housing as shown in FIG. 3(*a*).

There are four screw holes (51*a*), one in each corner of the broad wall (53) of the universal launcher adapter. Positions of the four screw holes (51*a*) are arranged to match the positions of four screw holes (50*a*) in the flange (50*b*) of the waveguide section (50) for mounting purpose. There are additional four screw holes (51*b*, 51*b*') in the universal launcher adapter (51). Positions of two of the four screw holes (51*b*) are arranged to match the positions of two screw holes (20*a*) in the major wall (28) of the conductive housing (20) when mounted in one position. Positions of two screw holes (51*b*') are also arranged to match the positions of the the other screw holes (20*a*) in the major wall (28) of the conductive housing (20) when mounted in the other position (see FIG. 3(*d*)).

When the L-shape waveguide probe (40) is mounted at the end portion of the first part of the pin (7), which extends outside the conductive housing (20), with the long axis (42*a*) of the second arm substantially perpendicular to the broad walls (20*b*) of the conductive housing, defining a reference plane, and with the broad wall (49, in FIG. 2) of the waveguide probe substantially perpendicular to the major exterior wall (28*a*) of the conductive housing, the electric field polarization of microwave signals excited by the L-shape waveguide probe will be substantially perpendicular to the broad walls (20*b*) of the conductive housing. As described before, it is preferable to fabricate the conductive housing so that the reference plane defined by the broad wall of the conductive housing is substantially parallel to a plane defined by the MMIC (24). When the universal launcher adapter (51' in FIG. 3(*b*)) is mounted to the major wall (28) by aligning screw holes (51*b*') to screw holes (20*a*), the polarization of the excited microwave signals will be perpendicular to the long walls (55) of the through channel. Hence, when the waveguide section (50) is mounted to the universal launcher adapter, with the cross-section of the cavity of the waveguide coinciding the through channel (52), microwave signals with polarization substantially perpendicular to the broad walls (56) of the waveguide section can be obtained and propagated. The electric polarization is now vertical with respect the broad walls, which are substantially parallel to the reference plane, of the universal conductive housing.

Alternately, if the L-shape waveguide probe (40) is rotated by 90 degrees with respect to the axis of pin (7) so that the second axis of the second arm is parallel to the broad wall (20*b*) and the major exterior wall (28*a*), the polarization of the excited microwave signals will be different. To guide the microwave signals, the universal launcher adapter (51') is also rotated by 90 degrees as shown in FIG. 3(*d*) to form a new end launcher (51). When the universal launcher adapter is mounted to the major wall (28), screw holes (51*b*) will be aligned to screw holes (20*a*). The polarization of the excited microwave signals is still perpendicular to the long walls (55) of the through channel. Hence, when the waveguide section (50) is mounted to the universal launcher adapter, with the cross-section of the cavity of the waveguide coinciding the through channel (52), microwave signals with polarization substantially perpendicular to the broad walls (56) of the waveguide section can be obtained and propagated. The electric polarization is now horizontal with respect the broad walls, which are substantially parallel to the reference plane, of the universal conductive housing. It is noted that, by providing a precision slot (54*s*) in one of the two short walls, the universal launcher adapter also serves as a universal impedance transformation section.

In order to achieve high efficiency excitation of microwave signals, as shown in FIG. 3(*a*), it is preferable to mount the L-shape waveguide probe so that the distance (57) between the major exterior wall (28*a*) and the long axis (42*a*) of the second arm in FIG. 2 is substantially equal to one quarter of a wavelength of the microwave signals to be excited and propagated. This can be achieved by designing the length (41*b* in FIG. 2) of the first arm to be slightly than one quarter of the wavelength.

From the above description, it is evident that microwave signals with controlled polarization with respect to the reference plane of the universal conductive housing can be excited and propagated through a receiving waveguide section using the L-shape waveguide probe provided in this invention. The universal launcher adapter may allow the adaptation of a waveguide section easily be made to the conductive housing in order to receive and propagate microwave signals with the controlled polarization.

As stated in the previous paragraph, the length (41*b* in FIG. 2) of the first arm is selected so that the second arm (42) is located at a distance (57) from the major exterior wall (28*a*) of the main body, as shown in FIG. 3(*a*). This distance (57) is approximately a quarter-wavelength of the operating frequency. Length (42*b* in FIG. 2) of the second arm is also selected to be approximately equal to a quarter-wavelength of the operating frequency so that it has good coupling to the waveguide mode. The first arm is required for the attachment of the probe to the pin (7) and provides a proper distance of the second arm from the major exterior wall (28*a*). Since the length of the first arm is approximately equal to a quarter-wavelength of the operating frequency, it is also used as an impedance transformer to fine adjust the matching between the waveguide radiation impedance of the probe and the transmission-line impedance in the conductive housing. Therefore, the width of the first arm (41 in FIG. 2) is also selected to provide adequate impedance for matching. As far as the width of the second arm (42) is concerned, it is chosen just for providing mechanical strength, for ease of manufacturing and assembly. More than one end launcher may be connected to the same universal conductive housing. In FIG. 3(*a*), (51") represents another end launcher.

For those skilled in the art, it is understood that the dimensions of cross section of the waveguide used are determined by the frequencies of the microwave signals to propagate. Once the dimensions of the waveguide section have been determined, dimensions of the non-symmetrical waveguide probes may be designed. Dimensions of the non-symmetrical waveguide probes should not be too large in order to avoid shorting and impedance mismatch. In order to reduce production cost of the L-shape waveguide probes, it is preferable to fabricate them by micro lithography and etching processes. In addition to reduction of cost, the purposes of employing the micro lithography and etching method to fabricate the non-symmetrical waveguide probes are [1] to increase the precision of dimensions and [2] to improve the component reproducibility. Details of the micro lithography fabrication of the waveguide probes are given below.

Referring to FIG. 4(*a*)–4(*d*), which provide flow diagrams of main fabrication steps and photo mask patterns, the fabrication of precision L-shape waveguide probes according to a second embodiment of this invention is performed as follows. As shown in FIG. 4(*a*), a brass substrate (60) with a thickness of about 10 mil is first solvent cleaned and baked dry. The thickness of the substrate 10 mil is selected to be the same as the diameter of central pin (7 in FIG. 3(*a*)) to facilitate the subsequent attachment of the waveguide probe to the pin. Although the value of 10 mil is given as an example for the substrate thickness, substrates with thickness other than 10 mil such as in a range 50 micrometers to 400 micrometers may be used. A first photoresist layer (61) of a thickness about 1–2 micrometers is then applied on the front surface and a second photoresist layer (62) is applied on the back surface of the brass substrate. After a soft baking at 90° C. for 10 minutes, the first photoresist layer (61) on the front surface is exposed to UV light through a first photo mask (63) while the second photoresist layer on the back surface is unexposed. It is noted that the purpose of the second photoresist layer is for protection of the substrate during subsequent etching. The first photo mask contains opaque regions (64) and transparent regions (65). These regions are designed so that a plurality of waveguide probes can be formed on a brass substrate in one fabrication run. A positive tone photoresist such as AZ-1820 from Shipley Company, Massachusetts may be used. Since AZ-1820 is a positive tone photoresist, the opaque regions (64) define the dimensions and shape of the non-symmetrical waveguide probes. According to this invention, it is preferred to connect all of the waveguide probes together electrically to facilitate the electrodeposition of Au or Ag layer. FIG. 4(*b*) shows a top view of the patterns on the first photomask used. To simplify the explanation, the first photomask provided contains nine non-symmetrical waveguide probe patterns (40*a*). Each of the waveguide probe patterns is connected electrically to adjacent four waveguide probe patterns by fine wire patterns (66*a,* 66*b*). The purpose of the fine wire patterns is to create fine brass wires after etching to provide electrical connection, to facilitate the electrodeposition of Au or Ag. Furthermore, a slot pattern (67*a*) is created in each waveguide probe pattern (40*a*). Hence after etching, a slot (67 in FIG. 4(*e*)) will be created in each non-symmetrical waveguide probe. This slot will allow the attachment of a waveguide probe to the end of the first part of pin (7) of the feedthrough as shown in FIG. 3(*a*). It is noted that the width (77*a*) of the slot pattern (67*a*) is selected so that after etching, the width (77 in FIG. 4(*d*)) of slot in the formed waveguide probe is slightly greater than the diameter of the pin (7) shown in FIG. 3(*a*).

After development of the photoresist on the front surface, the patterns on the first photomask shown in FIG. 4(*b*) is transferred onto the first photoresist layer with exposed brass regions and unexposed brass regions. The brass substrate with the photoresist patterns is then baked at 110 ° C. for 20 minutes. After this hard baking, exposed brass regions are etched by immersing the substrate in an etching solution containing ferric chloride, $FeCl_3$. Typical time required to etch through the 10 mil thick brass is about two minutes at room temperature. It is noted that the etching time may be reduced by agitating the solution or by increasing the solution temperature. It is further noted that the final dimensions of each waveguide probe are determined firstly by the dimensions of patterns in the photomask and secondly by the etching of the brass substrate. Since the dimensions of each prior art waveguide probes must be controlled precisely during the mechanical machining, the time required is long and the fabrication cost is high. FIG. 4(*c*) shows a cross-sectional view of the brass substrate after the etching. Each of the L-shape waveguide probes (40) formed is covered by a photoresist pattern (40*a*). It is noted that due to the etching, there is an edge recess or undercutting (U) in the peripheral regions for each waveguide probes (40). For clarity, the fine brass wires and fine photoresist patterns defining the fine brass wires (66, 66*b*') given in FIG. 4(*d*) are not shown. After this, the remaining photoresist patterns (40*a*)) and the photoresist (62) on the back surfaces of the waveguide probes (e.g. see FIG. 4(*c*)) are removed by immersing the substrate in acetone. This is followed by a rinse in de-ionized water. FIG. 4(*d*) is a schematic top view of the waveguide probes fabricated and before separation. It is noted that each L-shape waveguide probe (40) is connected to adjacent waveguide probes by fine brass wires (66, 66*b*'). It is noted that one slot (67) has been created for each L-shape waveguide probe for alignment purposes. A layer of gold is now plated over the surfaces of each waveguide probe while all of the waveguide probes are still connected together electrically. This is done by attaching one part of the connected waveguide probes to the cathode of an Au electrodeposition system (not shown) to deposit an Au layer with a thickness of 1–5 micrometers. The purposes of the Au layer are to increase the surface conductivity of the waveguide probes and to facilitate the attachment to the pin. After the Au deposition, the waveguide probes are rinsed in de-ionized water and dried. The fine brass wires (66, 66*b*') connecting adjacent waveguide probes are finally cut to isolate one waveguide probe from the others.

During the etching of the exposed substrate regions to form the L-shape waveguide probe, undercutting (U in FIG. 4(*c*)) is unavoidable. In order to increase the reproducibility of dimensions, it is preferred to reduce the amount of the undercutting. One method to reduce the undercutting is to carry out etching from both the front surface and the back surface of the substrate (60). To achieve this, a second photomask (not shown) is prepared to expose selectively the second photoresist layer (62). Patterns on the second photomask are similar to those on the first photomask, except that the ones on the second photomask are mirror images of the second photomask. The alignment of the second photomask against the substrate will be carried out in a special mask aligner (not shown) which allows the precise alignment of patterns on the second photomask to the patterns of the first photoresist layer created by the first photomask. Hence, after development, the patterns (not shown) on the back surface aligned precisely to the patterns (64, 65 FIG. 4(*a*)) on the front surface. The alignment of the patterns on the second photomask may be carried out after the patterns of the first photoresist layer have been developed. After the exposure of the second photoresist layer to the ultraviolet light through the second photomask, the second photoresist is developed and baked. Etching can now be proceeded from both sides in order to reduce the undercutting. Since the etching time required for the etching from both the front surface and back surface of the substrate is about half of that required from the front surface alone, the undercutting will be about half of the undercutting (U) in FIG. 4 (*c*).

Using the micro lithography and etching processes, in addition good reproducibility of dimensions, non-symmetrical waveguide probes with different dimensions for different frequency ranges can be fabricated in the same fabrication run. After the fabrication, the electrodeposition of the Au or Ag can be performed simultaneously layers to reduce the surface resistance. The micro lithography and etching method is particularly suitable for the fabrication of non-symmetrical waveguide probes, which are relatively difficult to manufacture using mechanical machining methods.

As stated before, the selection of dimensions of the waveguide probe will be made on the basis of the frequency range of operation. Some examples of the dimensions of the non-symmetrical waveguide probes for applications at different frequency ranges are provided here. It is noted that these values are provided as examples and in no way should be considered as limitations to this invention.

TABLE

Some dimension examples of the non-symmetrical conductive waveguide probes for operation at different frequency ranges

| Frequency Range (GHz) | A (mil) | B (mil) | C (mil) | D (mil) | E (mil) | F (mil) | T (mil) |
|---|---|---|---|---|---|---|---|
| 18–26 | 40 | 125 | 30 | 125 | 10 | 30 | 10 |
| 26–40 | 30 | 90 | 30 | 90 | 10 | 30 | 10 |
| 40–60 | 30 | 70 | 30 | 70 | 10 | 30 | 10 |
| 50–75 | 20 | 46 | 20 | 46 | 10 | 30 | 10 |

Here A and B are the width (41c in FIG. 2) and length (41b) of the first arm respectively, C and D are the width (42c) and length (42b) of the second arm, E and F are the width (45) and depth (46) of the slot and T is the thickness of the L-shape probe.

Figure 5:
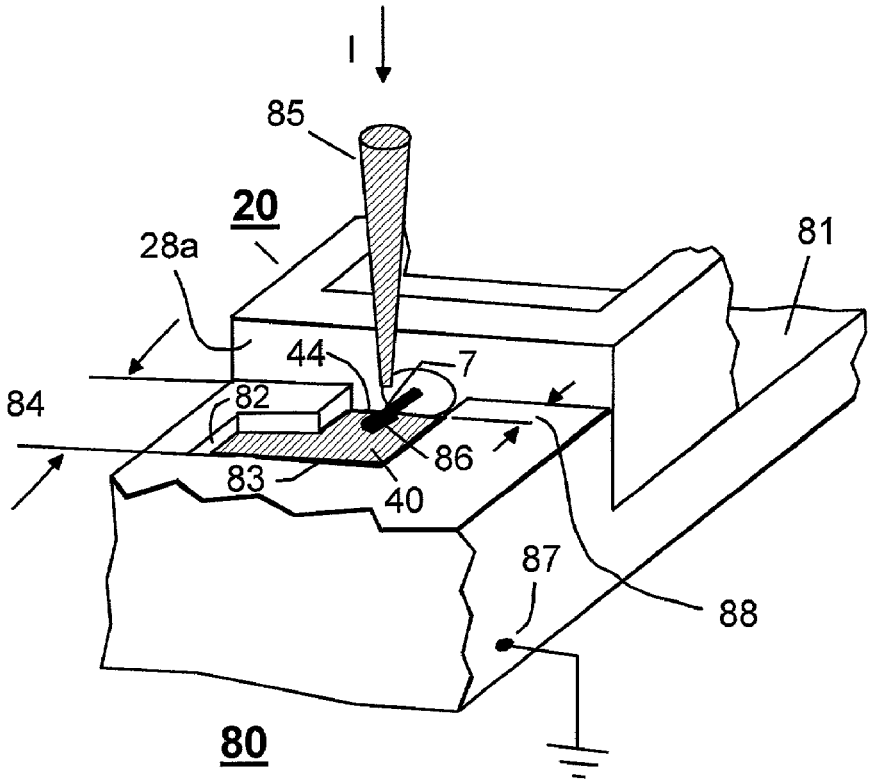
FIG. 5 is a schematic partial view of the conductive housing, L-shape waveguide probe in a precision alignment tool for aligning and mounting the L-shape waveguide probe to central metal pin of the feedthrough installed in the conductive housing.

According to a third embodiment, a non-symmetrical waveguide probe is attached precisely to the end portion of the pin to form an MMIC/waveguide transition. The precision and reproducibility of alignment are achieved using a novel alignment tool. Refer now to FIG. 5, where there is shown a partial view of the alignment tool (80), main parts of the alignment tool include a platform (81) to receive the housing (20) and a recessed cavity (82) to accommodate a non-symmetrical waveguide probe (40). This recessed cavity is precisely machined so that when the waveguide probe is placed in it, the slot (44) is facing the major exterior wall **(28*a*) of the universal conductive housing and the outer edge (83) of the second arm of the waveguide probe opposing the slot is aligned to and in contact with the wall of recessed cavity facing the pin. The protruding end (7) of the first part of the pin is aligned to the slot (44) of the waveguide probe. The alignment tool (80) is made of metals such as Al in order to prevent solder from sticking thereto during subsequent soldering process. The alignment tool is designed and manufactured such that when the universal conductive housing (20) is inserted with the attached pin facing the precision slot into said recessed cavity (82), the pin (7) is automatically aligned with the slot (44) of the waveguide probe. Fine adjustment can now be made under an optical microscope (not shown) to obtain the final precise position of the L-shape waveguide probe (40) relative to the end (7) of the pin. Using this alignment tool, the distance (84) between the outer edge (83) of the waveguide probe and the major exterior wall (28*a*) of the universal housing is determined by the depth of the recessed cavity. Since the length of the first part of the pin extending beyond the major exterior wall is known, the final position of the waveguide probe can be precisely adjusted and controlled using this tool. It is also noted that during the design of the non-symmetrical waveguide probes and the alignment jig, the distance (88) between the major exterior wall (28*a*) and the leading edge of the waveguide probe (40) should not be too small in order to avoid shorting and poor impedance matching. In addition, an electrical contact hole (87)** is provided to the alignment tool to facilitate micro soldering or welding of the waveguide probe.

After the final positional adjustment, a small preform (about 20 mils×20 mils×10 mils) of solder (86), such as an alloy containing 60% Sn and 40% Pb having a melting point of 183° C., is placed in a location near or on part of the gap formed between the pin and the slot of waveguide probe. The alignment tool is connected through an electrical contact hole (87) to the ground of a micro welding/soldering machine (not shown). The other electrical end of the micro welding/soldering machine is connected to a fine tungsten probe (85). To weld/solder the non-symmetrical waveguide probe (40) to the end of pin (7), a voltage is switched on and set to a predetermined value. The fine tungsten probe is then brought into contact with the pin. An electrical current (I) is passed through the pin and the universal housing, to generate heat in the region near the tip of the tungsten probe and the pin, causing the preform of the solder (86) to melt. Immediately after the melting, the melted solder flows and fills the gap formed between the pin and the slot of waveguide probe, the power to the micro welding machine is switched off to let heat dissipate and the solder solidify. The waveguide probe is now firmly and precisely attached to the pin. The housing with the attached waveguide probe may now be removed from the alignment tool. It is noted that during the waveguide probe attachment operation, the housing (20) may be turned by 90 degrees around the pin to a new position so that a waveguide section may be easily mounted to the housing to form a module. In this case, a new precision jig with a platform (81) of different vertical level is used.

Since the non-symmetrical L-shape waveguide probes are manufactured by the micro lithography and etching method, the dimensional uniformity and reproducibility can be improved compared to those for the prior art symmetrical plate-shape, cylindrical or conical waveguide probes. Furthermore, using the alignment tool to align and attach the non-symmetrical waveguide probe to the end of the pin, the reproducibility of positioning can be easily achieved. After the L-shape waveguide probe has been attached to the end portion of the pin, as shown in FIG. 3(*a*), a universal launcher adapter (51) is aligned and mounted to the conductive housing (20). A conventional waveguide section (50) is then mounted to the universal launcher adapter. Hence, after the mounting of the universal launcher adapter and the waveguide section, the L-shape waveguide probe is automatically aligned and located substantially at the center of the cross section of the waveguide section and universal launcher adapter, with the major broad surface (49) of L-shape waveguide probe aligned to be substantially perpendicular to the surface the major wall (28). A rectangular portion of the major exterior wall **(28*a*) defined by the through channel (52)** of the universal launcher adapter forms the short circuit end wall of the combination of the universal launcher adapter and the waveguide section. The L-shape waveguide probe is arranged so that the long axis of the second arm is located at a quarter wavelength distance from the short circuit end wall.

It is now clear that with this arrangement, the electric field polarization of the excited microwave signals by the L-shape plate waveguide probe can be controlled. Furthermore, the bandwidth of operating frequencies may be improved by designing dimensions of the L-shape waveguide probe.

Compared to the prior art symmetrical cylindrical or conical launching beads, or the symmetrical waveguide probe fabricated by the micro lithography and etching method, the performance of the non-symmetrical L-shape waveguide probe has been improved.

While the invention has been described in conjunction with illustrated embodiments, it will be understood that it is not intended to limit the invention to such embodiments. For instance, the L-shape waveguide probe may be fabricated using thin conductive wires. The thickness of the waveguide probes may be different from the one used in the examples, as long as they are thick enough so that the mechanical strength is sufficient to prevent deformation and vibration during operation.

What is claimed is:

1. An end launcher of microwave signals with controlled electric field polarization for transitioning between an MMIC and a waveguide connection, comprising:

a universal conductive housing having at least a broad wall and a major wall, at least one cavity with a platform for accommodating said MMIC and control components, having at least one feedthrough mounted in said major wall, each with one metal pin having a first end portion and a second end portion;

a conductive plate with a first arm having a first axis, a first length and a first width and a second arm having a second axis, a second length and a second width defining a first broad wall and a second broad wall of said conductive plate, said first arm and second arm defining a thickness and providing an L-shape waveguide probe, one end portion of said first aim having a slot with a slot width and a slot length for the connection to the first end portion of said metal pin of the feedthrough in said universal conductive housing, said L-shape waveguide probe being aligned so that the second axis is substantially parallel to said major wall of the universal conductive housing, the distance between the second axis and said major wall being selected on the basis of frequencies of the microwave signals;

a conductive universal launching adapter having a through channel with two long inner walls and two short inner walls, said two long inner walls and two short inner walls defining a cross-section of said through channel, said universal launching adapter being mounted to the major wall of said universal conductive housing; and a waveguide section with two broad inner walls and two narrow inner walls, said two broad inner walls and two narrow inner walls defining a cross-section of said through channel.

2. An end launcher of microwave signals for transitioning between an MMIC and a waveguide connection in claim 1, wherein said first length, second length, first width and second width of said L-shape waveguide probe being selected according to operating frequencies of said microwave signals and characteristic impedance.

3. An end launcher of microwave signals for transitioning between an MMIC and a waveguide connection in claim 1, wherein the distance between said major wall of the universal conductive housing and said second axis is selected to be substantially equal to a quarter of wavelength of microwave signals being excited.

4. An end launcher of microwave signals for transitioning between an MMIC and a waveguide connection in claim 1, wherein said slot width is slightly greater than a diameter of said metal pin to facilitate attachment of said L-shape waveguide probe to said metal pin.

5. An end launcher of microwave signals transitioning between an MMIC and a waveguide connection in claim 1, wherein said second axis of the L-shape waveguide probe also being parallel to said broad wall of the universal conductive housing, for the excitation of the microwave signals with electric fields substantially parallel to said broad wall of the universal conductive housing.

6. An end launcher of microwave signals for transitioning between an MMIC and a waveguide connection in claim 1, wherein said second axis of the L-shape waveguide probe also being perpendicular to said broad wall of the universal conductive housing, for the excitation of the microwave signals with electric fields substantially perpendicular to said broad wall of the universal conductive housing.

7. An end launcher of microwave signals for transitioning between an MMIC and a waveguide connection in claim 1 wherein an alignment of said L-shape waveguide probe to said metal pin is performed in a precision alignment jig, said precision alignment jig has one preformed shallow cavity to accept said L-shape waveguide probe and a receiving platform to accept said universal conductive housing, said distance between the second arm and the major wall of said universal conductive housing being maintained by separation between an edge of said receiving platform and said shallow cavity, the connection of said L-shape waveguide probe to said metal pin is achieved by soldering.

8. An end launcher of microwave signals for transitioning between an MMIC and a waveguide connection in claim 1 wherein said L-shape waveguide probe is fabricated by a micro lithography and etching method from a conductive sheet, a layer of metal is deposited on all walls of said L-shape waveguide probe to increase surface conductivity, said metal for the layer being selected from a group consisted of gold and silver.

9. An end launcher of microwave signals for transitioning between an MMIC and a waveguide connection in claim 1 wherein an alignment of said L-shape waveguide probe to said metal pin is performed in a precision alignment jig, said precision alignment jig has one preformed shallow cavity to accept said L-shape waveguide probe and a receiving platform to accept said universal conductive housing, said distance between the second arm and the major wall of said universal conductive housing being maintained by separation between an edge of said receiving platform and said shallow cavity, the connection of said L-shape waveguide probe to said metal pin is achieved by welding.

* * * * *